US010029346B2

(12) United States Patent
Ala et al.

(10) Patent No.: US 10,029,346 B2
(45) Date of Patent: Jul. 24, 2018

(54) EXTERNAL CLAMP RING FOR A CHEMICAL MECHANICAL POLISHING CARRIER HEAD

(71) Applicant: Applied Materials, Inc., Santa Clara, CA (US)

(72) Inventors: Patrick Ala, San Jose, CA (US); Bo B. Ding, Santa Clara, CA (US); Yongqi Hu, Santa Clara, CA (US); Simon Yavelberg, Cupertino, CA (US); Mats Larsson, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 12 days.

(21) Appl. No.: 15/176,998

(22) Filed: Jun. 8, 2016

(65) Prior Publication Data

US 2017/0106496 A1 Apr. 20, 2017

Related U.S. Application Data

(60) Provisional application No. 62/242,946, filed on Oct. 16, 2015.

(51) Int. Cl.
*B24B 37/32* (2012.01)

(52) U.S. Cl.
CPC ..... *B24B 37/32* (2013.01)

(58) Field of Classification Search
CPC ..... B24B 37/32
See application file for complete search history.

(56) References Cited

U.S. PATENT DOCUMENTS 6,159,079 A 12/2000 Zuniga et al.
6,361,420 B1 * 3/2002 Zuniga ..... B24B 37/30 451/288
6,406,361 B1 6/2002 Zuniga et al.
6,409,581 B1 6/2002 Robinson et al.
6,444,326 B1 * 9/2002 Smith ..... C09D 183/16 427/255.11
6,602,114 B1 * 8/2003 Wang ..... B24B 37/32 451/286
6,776,694 B2 * 8/2004 Zuniga ..... B24B 37/30 451/388
6,872,130 B1 3/2005 Zuniga
6,945,845 B2 9/2005 Bennett et al.
7,040,971 B2 * 5/2006 Zuniga ..... B24B 37/30 451/285
7,101,261 B2 9/2006 Shendon et al.
(Continued)

FOREIGN PATENT DOCUMENTS

KR 20130131120 A 12/2013

OTHER PUBLICATIONS

Dursan Specification Sheet—Jun. 2, 2015.*
International Search Report and Written Opinion for PCT/US2016/045626 dated Nov. 10, 2016.

*Primary Examiner* — Marc Carlson
(74) *Attorney, Agent, or Firm* — Patterson + Sheridan, LLP

(57) ABSTRACT

An external clamp ring for a chemical mechanical polishing (CMP) carrier head having a hydrophobic coating, and a carrier head having the same are described herein. In one embodiment, an external clamp ring is provided that includes a cylindrical body having an outer cylindrical wall and an inner cylindrical wall. A hydrophobic layer disposed is on the outer cylindrical wall.

20 Claims, 2 Drawing Sheets

(56) References Cited

U.S. PATENT DOCUMENTS

| | | | | |
|---|---|---|---|---|
| 7,883,397 | B2 | 2/2011 | Zuniga et al. | |
| 8,905,823 | B2 | 12/2014 | Wu et al. | |
| 9,381,613 | B2 * | 7/2016 | Leighton | B24B 37/30 |
| 2004/0005842 | A1 * | 1/2004 | Chen | B24B 37/30 451/41 |
| 2007/0049164 | A1 | 3/2007 | Thomson et al. | |
| 2008/0119119 | A1 * | 5/2008 | Zuniga | B24B 37/32 451/287 |
| 2009/0023368 | A1 * | 1/2009 | Wu | B24B 37/042 451/288 |
| 2010/0330886 | A1 | 12/2010 | Wu et al. | |
| 2011/0053479 | A1 | 3/2011 | Kim et al. | |
| 2012/0251797 | A1 * | 10/2012 | Smith | C23C 8/10 428/195.1 |
| 2013/0244025 | A1 * | 9/2013 | Smith | C23C 16/0272 428/336 |
| 2014/0154956 | A1 * | 6/2014 | Lee | B24B 37/32 451/56 |
| 2014/0235144 | A1 * | 8/2014 | Kim | B24B 37/30 451/294 |
| 2014/0370794 | A1 * | 12/2014 | Fukushima | B24B 37/32 451/387 |
| 2015/0099437 | A1 | 4/2015 | Martin et al. | |
| 2016/0023323 | A1 * | 1/2016 | Choi | B24B 37/32 156/345.14 |

* cited by examiner

EXTERNAL CLAMP RING FOR A CHEMICAL MECHANICAL POLISHING CARRIER HEAD

CROSS-REFERENCE TO RELATED APPLICATIONS

This application claims benefit of U.S. Provisional Application Ser. No. 62/242,946, filed Oct. 16, 2015 (Attorney Docket No. APPM/22607USL), of which is incorporated by reference in its entirety.

BACKGROUND

Field

Embodiments described herein generally relate to a clamp ring for use in a chemical mechanical polishing carrier head, wherein the clamp ring includes an outer cylindrical wall configured to prevent adherence and agglomeration of slurry particles to the clamp ring.

Description of Related Art

Integrated circuits are typically formed on substrates, such as silicon wafers, by sequential deposition of conductive, semiconductive, or insulative layers. After each layer is deposited, the layer is etched to create circuitry features. As a series of layers are sequentially deposited and etched, the outer or uppermost surface of the substrate, i.e., the exposed surface of the substrate, becomes increasingly non-planar. This non-planar outer surface presents a problem for the integrated circuit manufacturer. Therefore, there is a need to periodically planarize the substrate surface to provide a flat surface.

Chemical mechanical polishing (CMP) is one accepted method of planarization. CMP typically requires that the substrate be held by a carrier head in a manner that leaves a device side surface of the substrate exposed. The carrier head positions the substrate against a rotating polishing pad. The carrier head provides a controllable load, i.e., pressure, on the substrate to push the substrate against the rotating polishing pad. In addition, the carrier head may rotate to provide additional motion between the substrate and polishing surface.

A polishing slurry, including an abrasive and at least one chemically-reactive agent, may be supplied to the polishing pad to provide an abrasive chemical solution at the interface between the pad and the substrate. The polishing slurry may also contact and adhere to surfaces of the carrier head. Over time, the abrasives within the polishing slurry begin to agglomerate on the surfaces of the carrier head. The agglomerated slurry particles may dislodge from the surfaces of the carrier head, and fall onto the pad while polishing the substrate, which may result in scratching of the substrate. Scratches may result in substrate defects, which lead to performance degradation while polishing of the finished device. The agglomerated slurry particles are particularly problematic on surface with the carrier head that cannot be effectively rinsed between the polishing of substrates.

Therefore, there is a need to improve components of a carrier head to reduce the potential of polishing slurry to adhere to the carrier head.

SUMMARY

An external clamp ring for a chemical mechanical polishing (CMP) carrier head having a hydrophobic coating, and a carrier head having the same are described herein. In one embodiment, an external clamp ring is provided that includes a cylindrical body having an outer cylindrical wall and an inner cylindrical wall. A hydrophobic layer disposed is on the outer cylindrical wall.

In another embodiment, an external clamp ring for a chemical mechanical polishing carrier head is provided that includes a thin cylindrical band having an outer cylindrical wall and an inner cylindrical wall. A hydrophobic layer is disposed on the outer cylindrical wall. The hydrophobic layer is fabricated from a silicon-based coating material, a polytetrafluoroethylene—(PTFE or Teflon) based coating material or a carbon containing material.

In yet another embodiment, a carrier head is provided that includes a body, a retaining ring, a flexible membrane and an exterior clamp ring. The body has a mounting a top surface and a lower surface. The body also has a mounting ring extending from the lower surface of the body. The retaining ring is coupled to the body and circumscribes the flexible membrane. The flexible member has an outerside configured to contact a substrate retained in the carrier head. The external clamp ring secures the flexible membrane to the mounting ring. The external clamp ring has an outer cylindrical wall facing the retaining ring in a spaced apart relationship. The outer cylindrical wall is coated with a hydrophobic coating.

BRIEF DESCRIPTION OF THE DRAWINGS

The accompanying drawings, which are incorporated in and constitute a part of the specification, schematically illustrate the present invention and, together with the general description given above and the detailed description given below, serve to explain the principles of the invention.

For clarity, identical reference numerals have been used, where applicable, to designate identical elements that are common between figures. It is contemplated that elements disclosed in one embodiment may be beneficially utilized on other embodiments without specific recitation.

DETAILED DESCRIPTION

A clamp ring for use in a chemical mechanical polishing carrier head is described herein is configured to substantially reduce or prevent adherence and agglomeration of slurry particles to the clamp ring. The reduction of slurry particles to the clamp ring adhering to the clamp ring significantly reduces the likelihood of the slurry particles agglomerating on the clamp ring where the agglomerated particles could fall onto the polishing pad and become a source of substrate scratching. Thus, the clamp ring described herein significantly contributes to substrate defect reduction as compared to conventional clamp ring.

Figure 1:
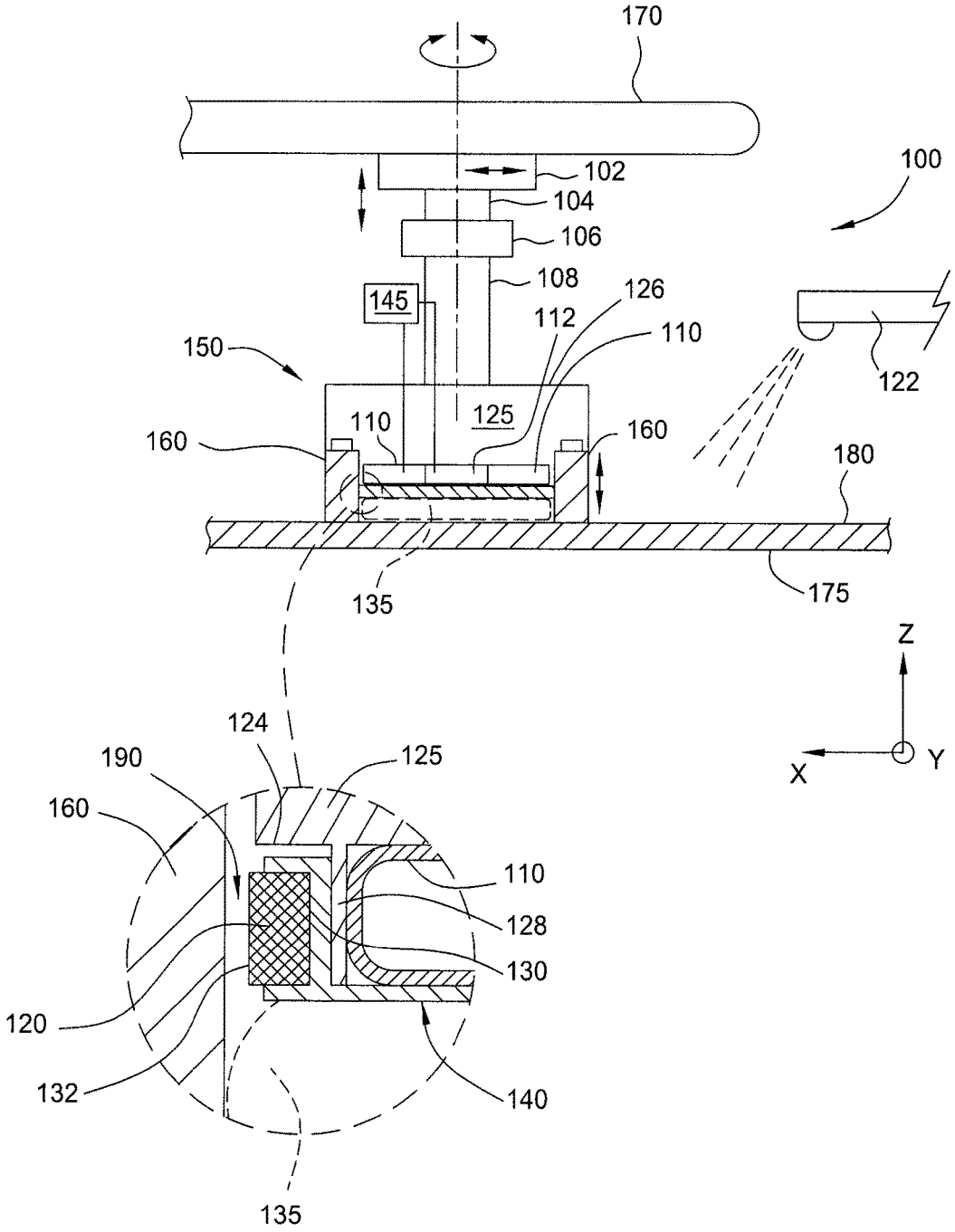
FIG. 1 illustrates a partial side sectional view of a chemical mechanical polishing (CMP) tool for polishing a substrate retained in a carrier head.

FIG. 1 is a partial cross-sectional view of an exemplary chemical mechanical polishing (CMP) system 100 that includes a carrier head 150 that utilizes one embodiment of an external clamp ring 120 for securing a flexible membrane 140 to the carrier head 150. The flexible membrane 140 is utilized to hold a substrate 135 (shown in phantom) retained in the carrier head 150 in contact with a polishing surface 180 of a polishing pad 175 during processing of the substrate 135 in the CMP system 100. The external clamp ring 120 includes a hydrophobic coating described further below with reference to FIG. 3 that significantly reduces the adhesion and agglomeration of slurry particles within the carrier head 150, thereby significantly reducing the potential for substrate defect generation during polishing on the CMP system 100.

Continuing to refer to FIG. 1, the CMP system 100 generally includes an arm 170 which supports the carrier head 150 over the polishing pad 175. At least one or both of the carrier head 150 and the polishing pad 175 are moved to impart relative motion between the substrate 135 retained in the carrier head 150 and the polishing pad 175 to process the substrate 135 in the presence of a polishing slurry provided to the polishing surface 180 of the polishing pad 175 by a polishing slurry delivery arm 122. In some embodiments, the least one or both of the carrier head 150 and the polishing pad 175 are rotated by the carrier head 150 presses the substrate 135 against the polishing surface 180 during processing.

In the embodiment depicted in FIG. 1, the carrier head 150 is coupled by a shaft 108 to the arm 170. An actuator 102, such as a motor, pneumatic cylinder and the like, is coupled to the shaft 108 and is operable to oscillate the carrier head 150 relative to the arm 170 in a direction parallel to the polishing surface 180. The carrier head 150 also includes an actuator 104, such as a motor, pneumatic cylinder and the like, to move the carrier head 150 in a direction relative to the polishing pad 175. For example, the actuator 104 may be utilized to press the substrate 135 retained in the carrier head 150 against the polishing surface 180 of the polishing pad 175 during processing. The carrier head 150 is also coupled to a rotary actuator 106, such as a motor and the like, that is operable to rotate the carrier head 150. Thus, the actuators 102, 106 may be utilized to move the carrier head 150 to provide relative motion of the substrate 135 relative to the polishing surface 180 of the polishing pad 175 during processing.

The carrier head 150 includes a body 125 circumscribed by a retaining ring 160. The retaining ring 160 circumscribes the substrate 135 held in the carrier head 150 so that the substrate 135 does not slip out from under the carrier head 150 during polishing. The retaining ring 160 may be coupled to the body 125 by an actuator 102. The actuator 102 may be operated to control the amount of force exerted on the polishing surface 180 of the polishing pad 175 independently from the force exerted on the polishing surface 180 by the substrate 135.

The body 125 generally includes a top surface 126 and a lower surface 124. The top surface 126 couples the body 125 to the shaft 108. The lower surface 124 includes a mounting ring 128 to which the flexible membrane 140 is secured by the external clamp ring 120. The connection between the mounting ring 128 and the flexible membrane 140 is further detailed with reference to FIG. 2 below.

Continuing to refer to FIG. 1, one or more bladders 110, 112 are disposed between the flexible membrane 140 and the lower surface 124 of the body 125. When two or more bladders 110, 112 are utilized, one or more bladders, such as bladder 110, may circumscribe the other bladders (such as bladder 112) or produce generally concentric zones across the backside of the flexible membrane 140. The bladders 110, 112 are coupled to a pressure source 145 that selectively delivers a fluid to the bladders 110, 112 to apply force to the flexible membrane 140, which transfers that force to the substrate 135. The pressure source 145 may apply the same or different pressures to each of the bladders 110, 112. In one embodiment, the bladder 110 may apply one force to an outer zone of the flexible membrane 140 while the bladder 112 applies force to a central zone of the flexible membrane 140. Forces applied to the flexible membrane 140 from the bladders 110, 112 are transmitted to portions of the substrate 135 and may be used to control the edge to center pressure profile that the substrate 135 asserts against the polishing surface 180 of the polishing pad 175. Additionally, vacuum may be applied to the bladders 110, 112 or the behind the flexible membrane 140 to apply a suction force against the backside of the substrate 135 facilitating retention of the substrate 135 in the carrier head 150. Examples of a carrier head 150 that may be adapted to benefit from the invention include the TITAN HEAD™, the TITAN CONTOUR™ and the TITAN PROFILER™ carrier heads, which are available from Applied Materials, Inc. of Santa Clara, Calif., among others, including those available from other manufactures.

Figure 2:
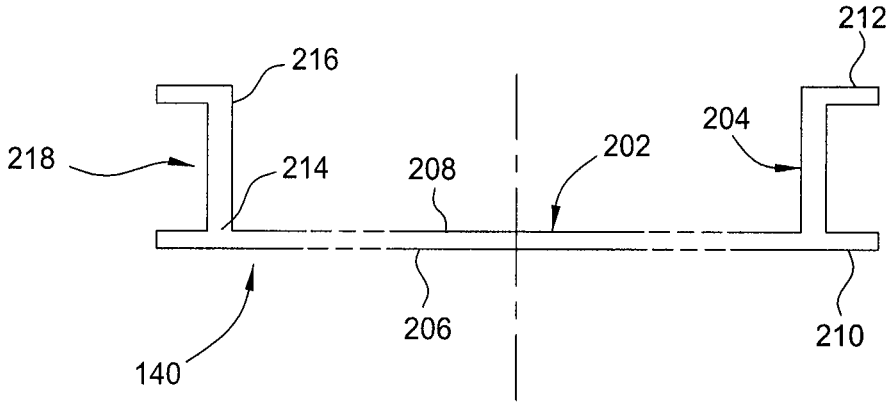
FIG. 2 illustrates an enlarged sectional view of a portion of the carrier head, illustrating a portion of an external clamp ring.

Referring now to an enlarged sectional view of a portion of the carrier head 150 depicting the connection between the mounting ring 128 and the flexible membrane 140 illustrated in FIG. 2, the flexible membrane 140 generally includes a center region 202 connected to a cylindrical wall 204. The flexible membrane 140 may be fabricated from a process compatible elastomer.

The center region 202 may be flat shaped disk, including an outerside 206 and an innerside 208. The outerside 206 generally contact the substrate 135 when retained in the carrier head 150, and the innerside 208 generally faces the lower surface 124 of the body 125 and contacts the one or more bladders 110, 112.

The cylindrical wall 204 generally extends from the innerside 208 of the flexible membrane 140 in a direction away from the outerside 206. The cylindrical wall 204 is sized to slip over the mounting ring 128 of the carrier head 150.

The cylindrical wall 204 may also include a lower lip 210 and an upper lip 212. The lower and upper lips 210, 212 extend radially outward from the cylindrical wall 204. The lower 210 may be disposed at a proximal end 214 of the cylindrical wall 204 proximate the connection between the cylindrical wall 204 and center region 202. In some embodiments, the lower lip 210 may be coplanar with the center region 202. The upper lip 212 is disposed on a distal end 216 of the cylindrical wall 204. The spacing between the lower and upper lips 210, 212 form a clamp ring receiving pocket 218.

The external clamp ring 120 is generally fabricated from a rigid process compatible material. In one embodiment, the external clamp ring 120 is fabricated from a metal, such as stainless steel, titanium, aluminum and the like. The external clamp ring 120 has an inner cylindrical wall 130 and an outer cylindrical wall 132. The inner cylindrical wall 130 is generally sized to be slightly larger than a diameter of the mounting ring 128. The outer cylindrical wall 132 of the external clamp ring 120 has a diameter smaller than a diameter of the retaining ring 160.

The external clamp ring 120 secures the flexible membrane 140 to the body 125 of the carrier head 150 by force fitting the external clamp ring 120 over the cylindrical wall 204 of the flexible membrane 140 while the flexible membrane 140 is positioned over the mounting ring 128. The external clamp ring 120 compresses the cylindrical wall 204 of the flexible membrane 140 against the external clamp ring 120, thereby securing the flexible membrane 140 to the carrier head 150. The external clamp ring 120 is generally slid over the lower lip 210 into the clamp ring receiving pocket 218 to assist positioning the external clamp ring 120 relative the flexible membrane 140. Once in the clamp ring receiving pocket 218, the outer cylindrical wall 132 is exposed to a space 190 disposed in the carrier head 150 laterally defined between the flexible membrane 140 and the retaining ring 160, as shown in the enlarged portion of FIG. 1. As the space 190 is open the exterior of the carrier head 150 and exposed to the polishing surface 180, polishing slurry may enter the space 190 during processing. Advantageously, the outer cylindrical wall 132 is configured to inhibit the polishing slurry within the space 190 from sticking to the outer cylindrical wall 132 of the external clamp ring 120 as further discussed below, thereby contributing to the rejection of potential defects to the substrate 135 while processing.

Figure 3:
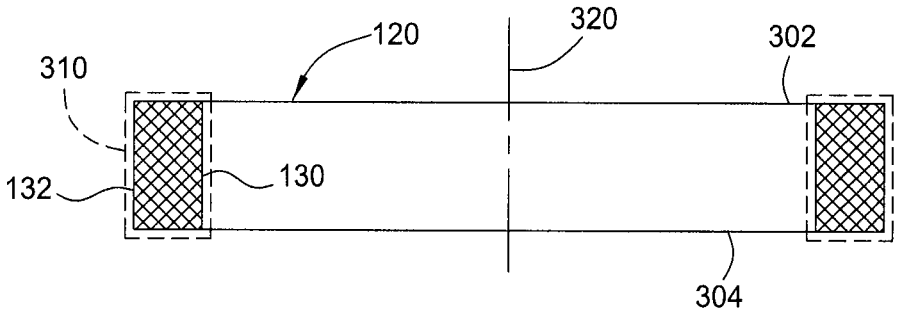
FIG. 3 is a sectional view of the external clamp ring.

FIG. 3 is a sectional view of the external clamp ring 120. As described above, the external clamp ring 120 includes inner and outer cylindrical walls 130, 132 which define the inner and outer diameters of the external clamp ring 120. The external clamp ring 120 also includes upper and lower walls 302, 304. The upper and lower walls 302, 304 may be parallel to each other, and perpendicular to a centerline 320 of the external clamp ring 120. The walls 130, 132, 302, 304 may be arranged to define a rectangular profile. In one embodiment, a width of the upper and lower walls 302, 304 are shorter than a height of the inner and outer cylindrical walls 130, 132 such that the profile of the external clamp ring 120 is a thin cylindrical band. For example, the width of the walls 302, 304 may be less than a quarter of the height of the inner and outer cylindrical walls 130, 132.

In one or more embodiments, at least the outer cylindrical wall 132 of the external clamp ring 120 is covered with a hydrophobic coating 310. Optionally, one or more of the other walls 130, 302, 304 may also be covered with the hydrophobic coating 310. The hydrophobic coating 310 disposed on the outer cylindrical wall 132 inhibits adherence of polishing slurry to the external clamp ring 120, thus substantially contributing to the prevention of slurry particle agglomeration on the external clamp ring 120 and ultimately to the reduction of substrate defects.

As discussed above, the hydrophobic coating 310 may optionally be disposed on the inner cylindrical wall 130, which assists slipping the external clamp ring 120 into position over the flexible membrane 140. The presence of the hydrophobic coating 310 on the inner cylindrical wall 130 allow installation of the external clamp ring 120 with a tighter fit against the mounting ring 128, resulting in higher compression the flexible membrane 140 while ultimately provides improved retention of the flexible membrane 140 to the body 125 of the carrier head 150. Optionally, the hydrophobic coating 310 may omitted from one or more of the inner cylindrical wall 130 and upper and lower walls 302, 304 to reduce the cost of the external clamp ring 120. Optionally omitting the hydrophobic coating 310 from one or more of the upper and lower walls 302, 304 may help retain the external clamp ring 120 in the clamp ring receiving pocket 218.

The hydrophobic coating 310 may be a silicon-based coating, a PTFE-based coating or other hydrophobic coating material. PTFE-based coating materials suitable for use as the hydrophobic coating 310 include perfluoroalkoxy alkane (PFA), fluorinated ethylene propylene (FEP), among others. The hydrophobic coating 310 may have a thickness of less than about 30 μm for a PTFE-based coating, such as between about 5 μm and about 25 μm. Silicon-based coating materials suitable for use as the hydrophobic coating 310 include carboxysilane, among others. The hydrophobic coating 310 may have a thickness of less than about 2 μm for the silicon-based coating materials, such as between about 0.4 μm and about 1.6 μm. Carbon-based coating materials suitable for use as the hydrophobic coating 310 include fluorocarbon, among others. The hydrophobic coating 310 may have a thickness of less than about 100 nm for fluorocarbon.

Other coating materials suitable for use as the hydrophobic coating 310 include carbon containing materials, such as parylene (polyparaxylylene), for example Parylene C (chlorinated linear polyparaxylylene), Parylene N (linear polyparaxylylene), and Parylene X (cross-linked polyparaxylylene). Other carbon-containing materials which may be used include PEEK (polyether ether ketones) and diamond-like carbon (DLC).

The hydrophobic coating 310 may be applied in an additive manufacturing operation, such as during a printing process used to form the hydrophobic coating 310. Alternately, the hydrophobic coating 310 may be applied by spraying, dipping or other suitable method. In some embodiments, the hydrophobic coating 310 on the outer cylindrical wall 132 may have an arithmetic average of absolute values surface roughness ($R_a$) of less than about 32 micro-inches.

In some embodiments, the outer cylindrical wall 132 of the external clamp ring 120 may have a surface roughness of less than about 16 micro-inches Ra. The smooth surface finish of the outer cylindrical wall 132 of the external clamp ring 120 causes the hydrophobic coating 310 also to be very smooth, i.e., last than the finish of the wall 132, which contributes to inhibiting adhesion of the polishing slurry to the external clamp ring 120. In some applications where the polishing slurry is not particularly prone to sticking to the surfaces of the carrier head, the hydrophobic coating 310 may optionally be omitted from the outer cylindrical wall 132 of the external clamp ring 120 if the surface roughness of the outer cylindrical wall 132 is less than or equal to about 16 micro-inches Ra.

The other walls 130, 302, 304 of the external clamp ring 120 generally have a surface finish of about 32 micro-inches Ra or higher. Particularly, the 32 micro-inches Ra or higher surface finish on the inner cylindrical wall 130 helps retain the external clamp ring 120 in position over the cylindrical wall 204 of the flexible membrane 140. Using a surface finish of less than 32 micro-inches $R_a$ or higher when not needed generally allows the cost of the external clamp ring 120 to reduced, while still preventing the adherence of slurry particles to the external clamp ring 120.

Thus, an external clamp ring has been described above that substantially reduces or prevents adherence and agglomeration of slurry particles to the outer cylindrical wall of the external clamp ring. The reduction of slurry particles to the clamp ring adhering to the clamp ring significantly reduces the likelihood of the slurry particles agglomerating on the clamp ring where the agglomerated particles could fall onto the polishing pad and become a source of substrate scratching. Thus, the clamp ring described herein significantly contributes to substrate defect reduction as compared to conventional clamp ring.

What is claimed is:

1. An external clamp ring for a chemical mechanical polishing carrier head, the external clamp ring comprising:

a cylindrical body having a top surface, a bottom surface, an outer cylindrical wall and an inner cylindrical wall; and a hydrophobic layer disposed on the outer cylindrical wall and the inner cylindrical wall of the body, whereas the top surface and the bottom surface do not have the hydrophobic layer disposed thereon.

2. The external clamp ring of claim 1, wherein the hydrophobic layer has a thickness of between about 400 nm and about 100 nm.

3. The external clamp ring of claim 1 wherein the top surface and bottom surface have a width shorter than a height of the inner and outer cylindrical walls.

4. The external clamp ring of claim 3, wherein the width of the top surface and bottom surface may be less than a quarter of the height of the inner and outer cylindrical walls.

5. The external clamp ring of claim 1, wherein the cylindrical body further comprises:

a thin cylindrical band.

6. The external clamp ring of claim 1, wherein the hydrophobic coating on the outer cylindrical wall comprises:

a surface roughness of less than or equal to about 16 micro-inches Ra.

7. The external clamp ring of claim 1, wherein the outer cylindrical wall comprises:

a surface roughness of less than or equal to about 16 micro-inches Ra.

8. The external clamp ring of claim 7, wherein the inner cylindrical wall comprises:

a surface roughness of less than or equal to about 16 micro-inches Ra.

9. The external clamp ring of claim 1, wherein the hydrophobic coating comprises:

a silicon-based coating material, or a carbon containing material.

10. The external clamp ring of claim 1, wherein the hydrophobic coating comprises:

a silicon-based coating material consisting of carboxysilane.

11. The external clamp ring of claim 1, wherein the hydrophobic coating comprises:

a PTFE-based coating material selected from the group consisting of perfluoroalkoxy alkane (PFA), fluorinated ethylene propylene (FEP).

12. The external clamp ring of claim 1, wherein the hydrophobic coating comprises:

a carbon containing material selected form the group consisting of parylene (polyparaxylylene), Parylene C (chlorinated linear polyparaxylylene), Parylene N (linear polyparaxylylene), Parylene X (cross-linked polyparaxylylene), polyether ether ketone and diamond-like carbon (DLC).

13. The external clamp ring of claim 1, wherein the hydrophobic coating is applied using an additive manufacturing operation, spraying or dipping.

14. An external clamp ring for a chemical mechanical polishing carrier head, the external clamp ring comprising:

a thin cylindrical band having a top wall, a bottom wall, an outer cylindrical wall and an inner cylindrical wall; and a hydrophobic layer disposed on the outer cylindrical wall and inner cylindrical wall and not the top wall or bottom wall, the hydrophobic layer comprising a silicon-based coating material.

15. The external clamp ring of claim 14, wherein the hydrophobic layer has a thickness of between about 400 nm and about 100 nm.

16. The external clamp ring of claim 14, wherein the hydrophobic coating on the outer cylindrical wall comprises:

a surface roughness of less than about 16 micro-inches Ra.

17. The external clamp ring of claim 14, wherein the outer cylindrical wall comprises:

a surface roughness of less than or equal to about 16 micro-inches Ra.

18. The external clamp ring of claim 17, wherein the hydrophobic coating on the inner cylindrical wall comprises:

a surface roughness of less than or equal to about 32 micro-inches Ra.

19. The external clamp ring of claim 14, wherein the hydrophobic coating comprises:

a coating material selected from the group consisting of carboxysilane, parylene (polyparaxylylene), Parylene C (chlorinated linear polyparaxylylene), Parylene N (linear polyparaxylylene), Parylene X (cross-linked polyparaxylylene), polyether ether ketone and diamond-like carbon (DLC).

20. A carrier head comprising:

a body having a top surface and a lower surface, the lower surface of the body having a mounting ring extending therefrom;

a retaining ring coupled to the body;

a flexible membrane disposed inward of and circumscribed by the retaining ring, the flexible member having an outerside configured to contact a substrate retained in the carrier head; and an external clamp ring securing the flexible membrane to the mounting ring, the external clamp ring having an upper wall, a lower wall, inner cylindrical wall and an outer cylindrical wall facing the retaining ring in a spaced apart relationship, the inner cylindrical wall and the outer cylindrical wall coated with a hydrophobic coating omitted from both the upper wall and the lower wall.

* * * * *